US007461809B1

(12) United States Patent
Maley

(10) Patent No.: US 7,461,809 B1
(45) Date of Patent: Dec. 9, 2008

(54) MOBILE WIRE DISPENSING APPARATUS

(76) Inventor: William H. Maley, 2303 Lake Shore Dr., Oakland, MD (US) 21550-7283

( * ) Notice: Subject to any disclaimer, the term of this patent is extended or adjusted under 35 U.S.C. 154(b) by 0 days.

(21) Appl. No.: 11/820,970

(22) Filed: Jun. 21, 2007

(51) Int. Cl.
*B65H 16/02* (2006.01)

(52) U.S. Cl. ..... 242/557

(58) Field of Classification Search ..... 242/403, 242/533.8, 557, 598.5
See application file for complete search history.

(56) References Cited

U.S. PATENT DOCUMENTS

| | | | | | |
|---|---|---|---|---|---|
| 1,016,490 | A | * | 2/1912 | Grigg | 242/557 |
| 2,355,441 | A | * | 8/1944 | Jacob | 242/557 |
| 2,598,992 | A | * | 6/1952 | Gordon | 242/557 |
| 3,050,273 | A | * | 8/1962 | Saunders | 242/557 |
| 3,134,555 | A | | 5/1964 | Baker | |
| 3,831,877 | A | * | 8/1974 | Bennett et al. | 242/594.3 |
| 3,937,414 | A | | 2/1976 | Bank et al. | |
| 4,137,939 | A | * | 2/1979 | Chow | 137/355.27 |
| 4,208,021 | A | | 6/1980 | Wall | |
| 4,497,470 | A | * | 2/1985 | Carter et al. | 254/134.3 FT |
| 4,649,954 | A | * | 3/1987 | Dunwoody | 137/355.17 |
| 5,509,671 | A | * | 4/1996 | Campbell | 242/594.6 |
| 5,577,745 | A | * | 11/1996 | Birk | 242/129.5 |
| 5,732,899 | A | * | 3/1998 | Wells | 242/598.3 |
| 6,698,682 | B1 | | 3/2004 | Roderick | |

* cited by examiner

*Primary Examiner*—William A Rivera
(74) *Attorney, Agent, or Firm*—Carothers & Carothers

(57) ABSTRACT

A mobile wire dispensing apparatus for carrying and moving spools of wire to desired locations. The mobile wire dispensing apparatus includes a conventional hand truck having a longitudinally extending frame with wheels at one end and a handle at the other end, and a foot plate at the wheeled end projecting at a right angle to the frame. The hand truck is converted to a wire dispensing apparatus with a kit which includes upper and lower V-shaped frames having an apex and two legs diverging from the apex to distal ends, whereby the distal ends of the V-shaped frames are securable to the frame of the hand truck at spaced locations with the V-frames being aligned and the lower V-shaped frame engaging the inside of the footplate. A hub socket is provided on the apex of the lower V-shaped frame and protrudes upwardly towards the apex of the upper V-shaped frame to receive a wire spool core end over the hub. A shaft is dimensioned to span between the two apexes of the V-shaped frames and is received at the bottom end into the hub socket after passing through at least one wire spool, and then the upper end of the shaft is secured to the apex of the V-shaped frame. Through shaft eye sleeves may also be provided on each leg of the V-shaped frames intermediate their apexes and distal ends and are aligned for thereby slidably receiving therein a parallel pair of spool shafts with bottom ends of the spool shafts engaging the footplate of the hand truck as a stop. This latter arrangement permits the mounting of multiple smaller wire spools instead of using a single shaft for the larger heavier spools.

2 Claims, 6 Drawing Sheets

MOBILE WIRE DISPENSING APPARATUS

FIELD OF THE INVENTION

The present invention relates to mobile wire dispensers and more particularly pertains to a new mobile wire dispensing apparatus for carrying and moving spools of wire to desired locations.

BACKGROUND OF THE INVENTION

It is a principal object of the present invention to provide a mobile wire dispensing apparatus in the form of a kit which converts a standard hand truck into a cable or wire reel dispenser with the ability to not only deliver heavy cumbersome reels or spools to a work location, but to also uncoil the cable or wire in an organized manner.

SUMMARY OF THE INVENTION

The mobile wire dispensing apparatus of the present invention includes a hand truck which has a longitudinally extending frame having wheels at one end a handle at the other end for manipulating the frame for movement on the wheels, and a foot plate at the wheeled end of the frame which projects at a right angle from the frame. Upper and lower V-shaped frames are provided with each having an apex and two legs diverging from the apex to distal ends. The lower V-shaped frame is secured at the distal ends of its legs to the hand truck frame and rests against the upper or inside surface of the footplate. The upper V-shaped frame is secured at its distal ends of the legs to the hand truck frame in spaced parallel alignment with the lower V-shaped frame.

A hub socket is provided on the apex of the lower V-shaped frame and protrudes towards the apex of the upper V-shaped frame in order to receive a wire spool core end over the hub for initial placement. After the spool or stacked spools have been positioned over the hub of the lower V-shaped frame, a shaft, dimensioned to span between the apexes, is passed through the spools and received at the bottom end into the hub socket of the lower V-shaped frame after passing through one or more wire spools. Then the other upper end of the shaft is swung toward and into an apex socket of the upper V-shaped frame and there secured, thus providing the fully assembled mobile wire dispensing apparatus of the present invention.

The lower and upper V-shaped frames also are provided with through shaft eye sockets on each leg intermediate the apexes and the distal ends. These through shaft eye sockets are aligned for slidably receiving therein a parallel pair of spool shafts with the bottom ends of the spool shafts engaging the foot plate of the hand truck as a stop. This arrangement is employed instead of the previously described single shaft arrangement, where smaller spools and more spools of wire are utilized.

The mobile wire dispensing apparatus of the present invention is thus provided in the form of a conversion kit for easily and quickly converting a conventional hand truck into a mobile wire dispensing apparatus. When the apparatus is no longer required to be in use, the apparatus may be disassembled so that the hand truck can be once again used in conventional fashion. The apparatus of the present invention eliminates the need for costly reel dispensing equipment that takes up valuable space when not in use. The apparatus of the present invention also reduces injuries which might otherwise be incurred if the worker were required to hand carry the heavy spools of wire or cable.

In the first single support shaft configuration, an electrician can handle two 1,000 foot reels of Romex, which are as much as 110 pounds each, and can uncoil and install wire from the reels without assistance. In the second double shaft configuration, an electrician can utilize the small spool delivery system of this embodiment and install as many as twelve 500 foot reels of single conductor wire without assistance. Since the average reel of single conductor wire weight is 15 to 20 pounds each, the total load weight can be as much as 240 pounds, which is well within the hand truck weight limit.

BRIEF DESCRIPTION OF THE DRAWINGS

Other objects and advantages appear hereinafter in the following description and claims. The accompanying drawings show, for the purpose exemplification, without limiting the scope of the invention or the appended claims, certain practical embodiments of the present invention wherein;

DETAILED DESCRIPTION OF A PREFERRED EMBODIMENT

Figure 1A:
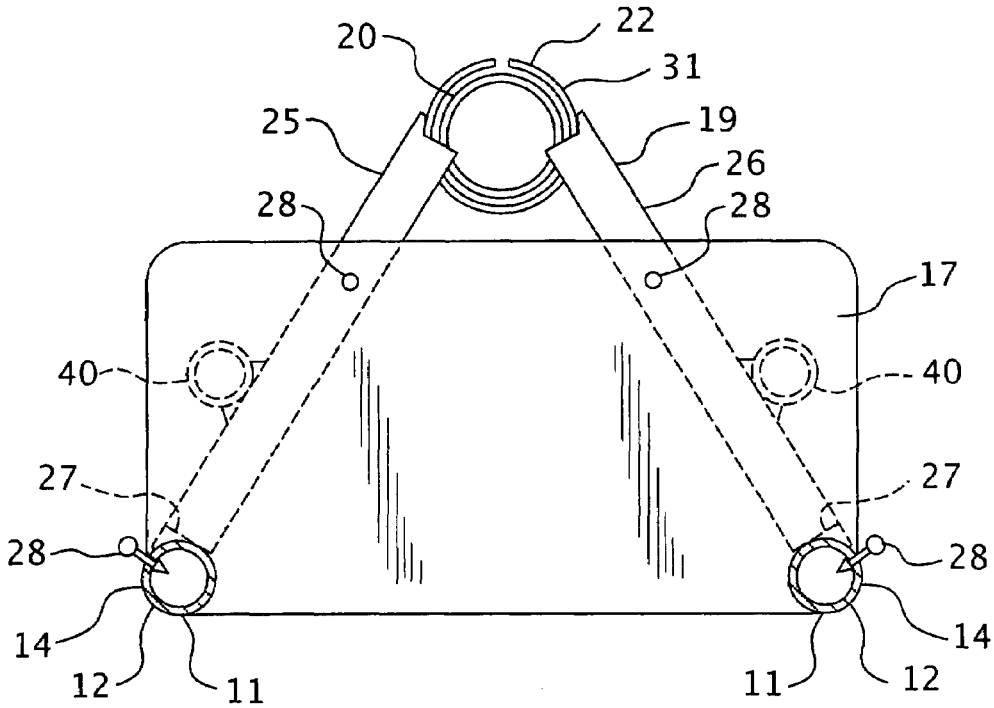
FIG. 1A is a bottom view of the lower V-shaped frame secured to a hand truck utilized in the mobile wire dispensing apparatus of the present invention.

Referring to FIGS. 1 through 5, the mobile wire dispensing apparatus 10 of the present invention includes a conventional hand truck 11 having a longitudinally extending frame 12 with wheels 13 at one end 14 and a handle 15 at the other end 16 for manipulating the frame 12 for movement on wheels 13. The hand truck 11 further includes a foot plate 17 projecting at a right angle from frame 11 at end 14.

The kit which modifies the hand truck 11 into a mobile wire dispensing apparatus of the present invention includes upper and lower V-shaped frames 18 and 19 and a spool shaft 20. The upper and lower V-shaped frames 18 and 19 each have respectively an apex 21 and 22 and two diverging legs 23 and 24 and 25 and 26 respectively, which are fabricated from angle iron, with distal ends 27 which are respectively secureable to the frame 12 with a conventional securing mechanism such as self tapping screws 28. The lower V-shaped frame 19 in addition rests against the inside surface 30 of foot plate 17 and also secured thereto with additional screws 28.

The upper and lower V-shaped frames 18 and 19 are thus secured to frame 12 in spaced parallel alignment.

Figure 3:
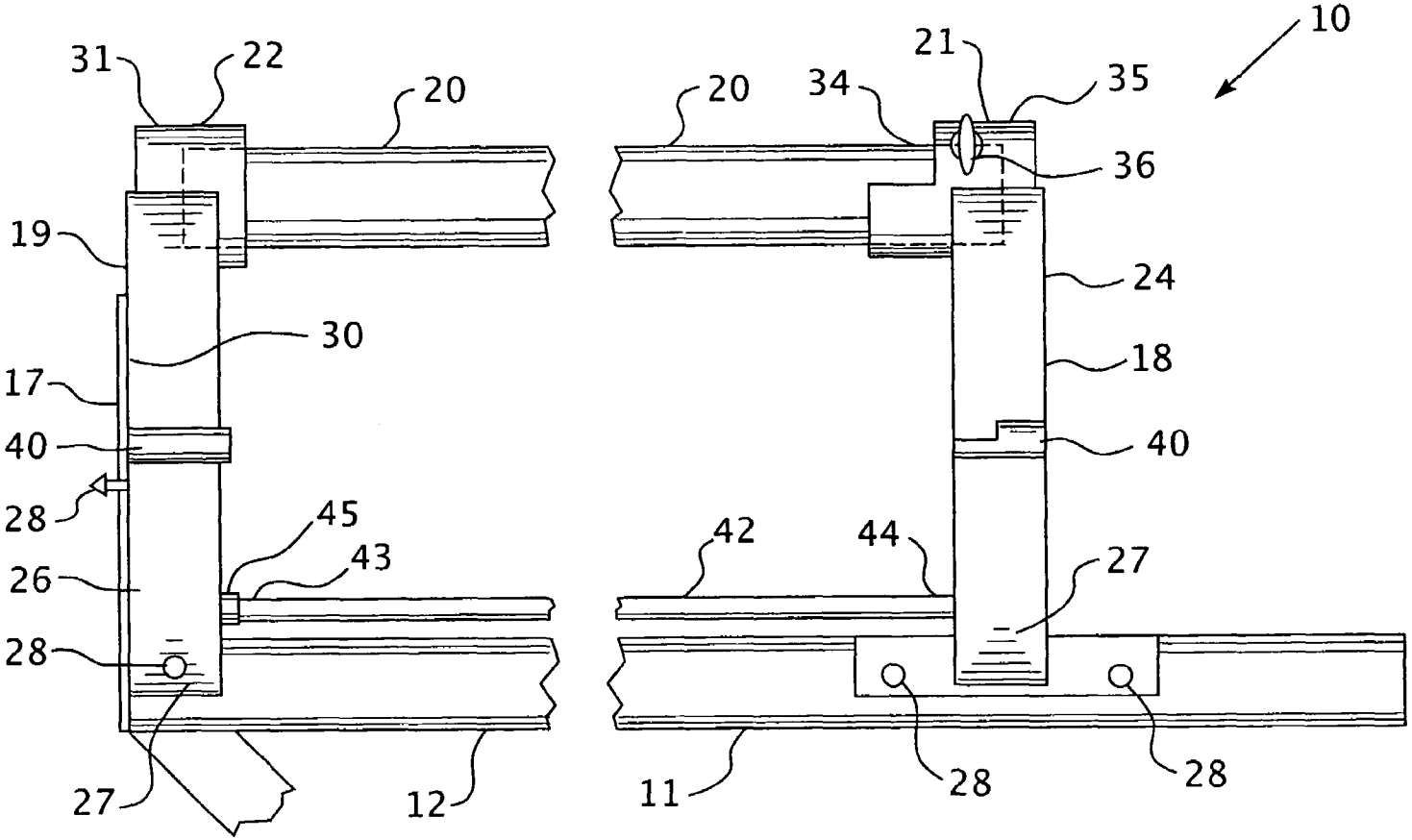
FIG. 3 is an enlarged sectioned side view of the assembly shown in FIG. 2 in a horizontal position.
Figure 4:
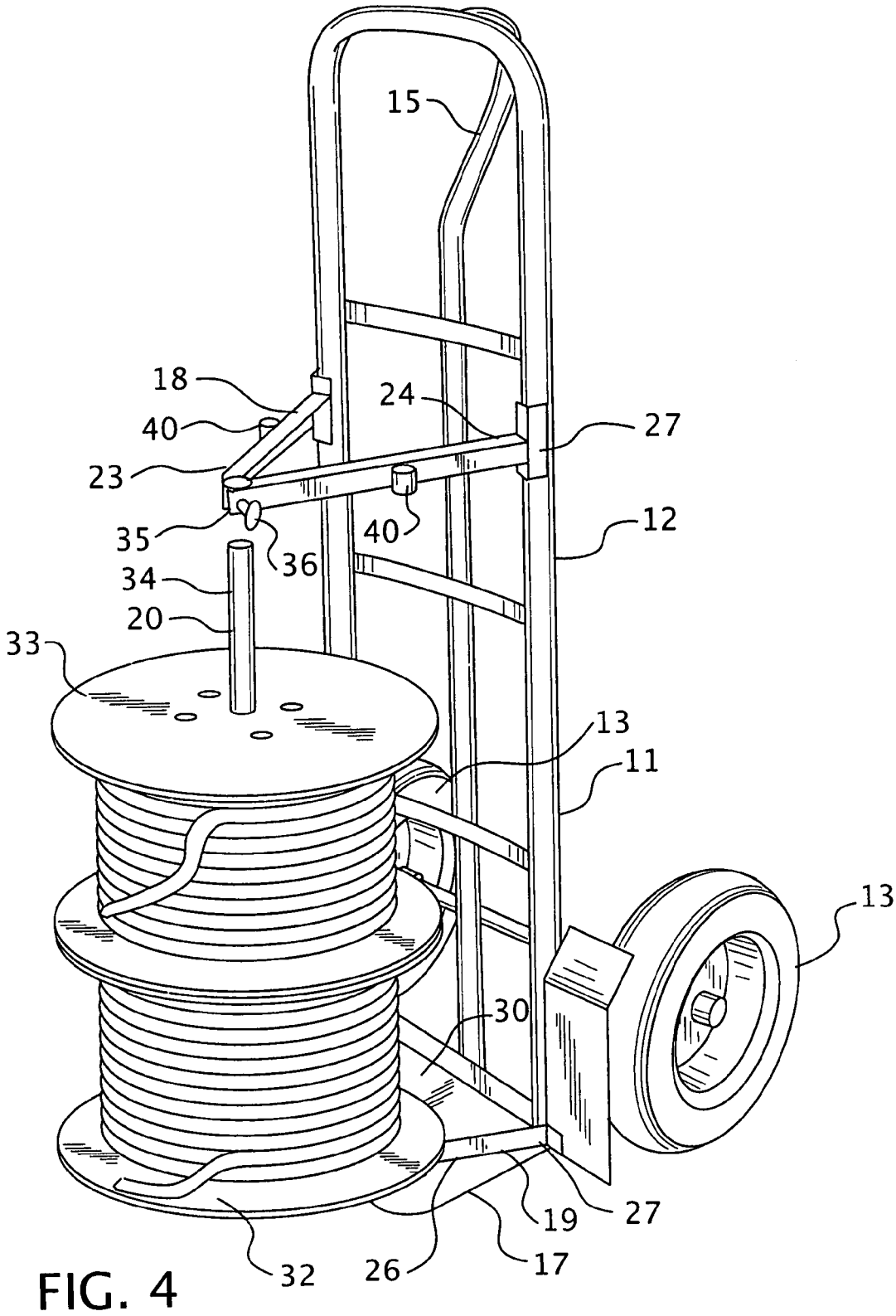
FIG. 4 is a perspective view of the assembly shown in FIG. 2 with two wire spools stacked on top of the lower V-shaped frame and a shaft inserted downwardly through the two spools and into a hub socket provided in the apex of the lower V-shaped frame.
Figure 5:
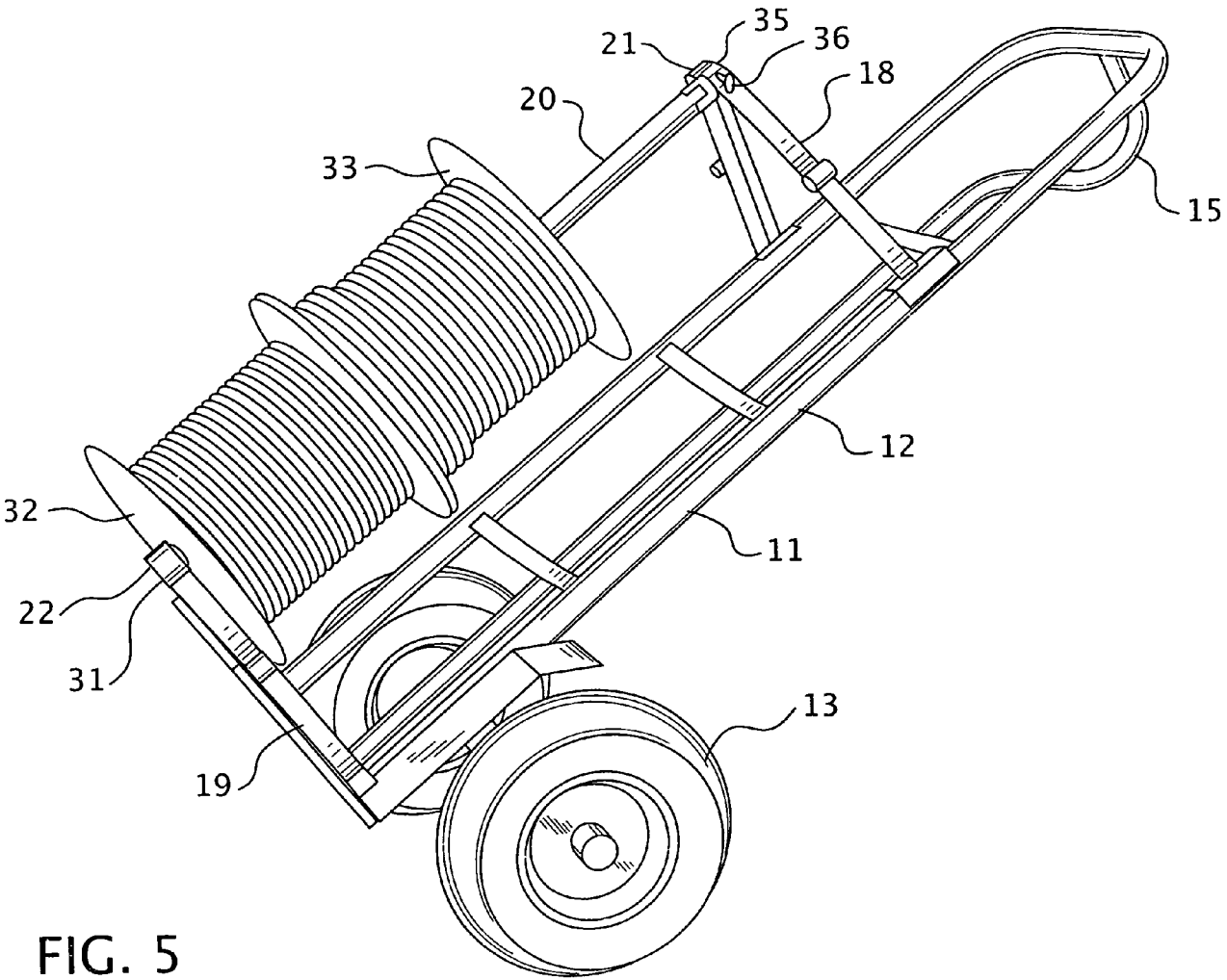
FIG. 5 is perspective view of the assembly shown in FIG. 4 with the upper end of the shaft running through the spools being secured to the apex of the upper V frame, with the complete apparatus shown in an inclined position and being towed by a worker to move the coils to a work location.

Hub socket 31 is provided on the apex 22 of lower V-shaped frame 19 and protrudes towards the apex 21 of upper V-shaped frame 18 to receive a wire spool core end thereover, as illustrated in FIG. 3. The two spools 32 and 33 are stacked with lower spool 32 being positioned with its bottom end spool core received around and overtop of socket 31. Shaft 20 is then inserted down through the spools 33 and 32 and the bottom end thereof is received into hub socket 31. Thereafter, the upper end 34 of shaft 20 is swung over to engage the apex socket 35 provided in the apex 21 of upper V-frame 18 and therein raised and secured in position with a conventional thumb screw 36. The mobile wire dispensing apparatus 10 is then completed and ready for mobile use as indicated in FIG. 5.

Figure 6:
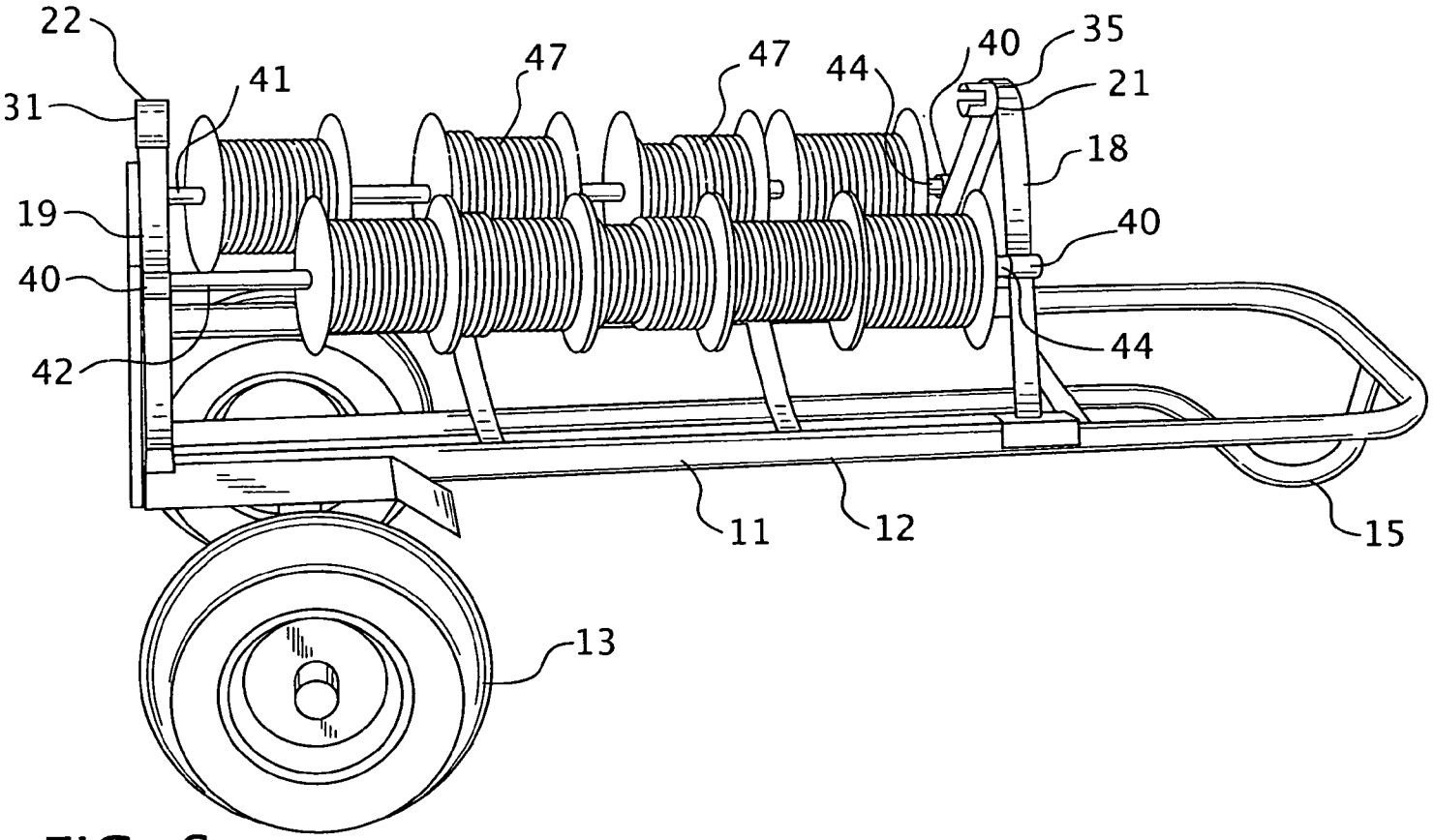
FIG. 6 is a perspective view of the mobile wire dispensing apparatus of the present invention illustrating the apparatus as being used with two spaced parallel shafts for smaller spools as opposed to a single shaft for large spools as shown in FIG. 5.

Referring next specifically to FIG. 6, in addition to the previous figures, a second possible arrangement for the mobile wire dispensing apparatus 10 of the present invention is illustrated. Through eye sleeves 40 are provided on each leg 23, 24, 25 and 26 of the upper and lower V-frames 18 and 19. The eye sleeves 40 on each side of the apparatus 10 are aligned and dimensioned to slidably receive therethrough one of the two parallel shafts 41 or 42. The through shaft eye sleeves 40 are positioned on the respective legs of the V-shaped frames 18 and 19 intermediate their respective apexes 21 and 22 and their distal ends 27 whereby they are aligned for thereby slidably receiving therein the parallel pair of spool shafts 41 with the bottom ends 43 thereof engaging the inside surface 30 of foot plate 17 as a stop. The upper ends 44 are retained in the through sleeves 40 provided on the legs of upper V-shaped frame 18 without further requirement of securement.

With this arrangement a larger number of smaller spools 47 can be utilized on the mobile wire dispensing apparatus 10 of the present invention, as for example when dispensing single wire strands on smaller spools.

Figure 1B:
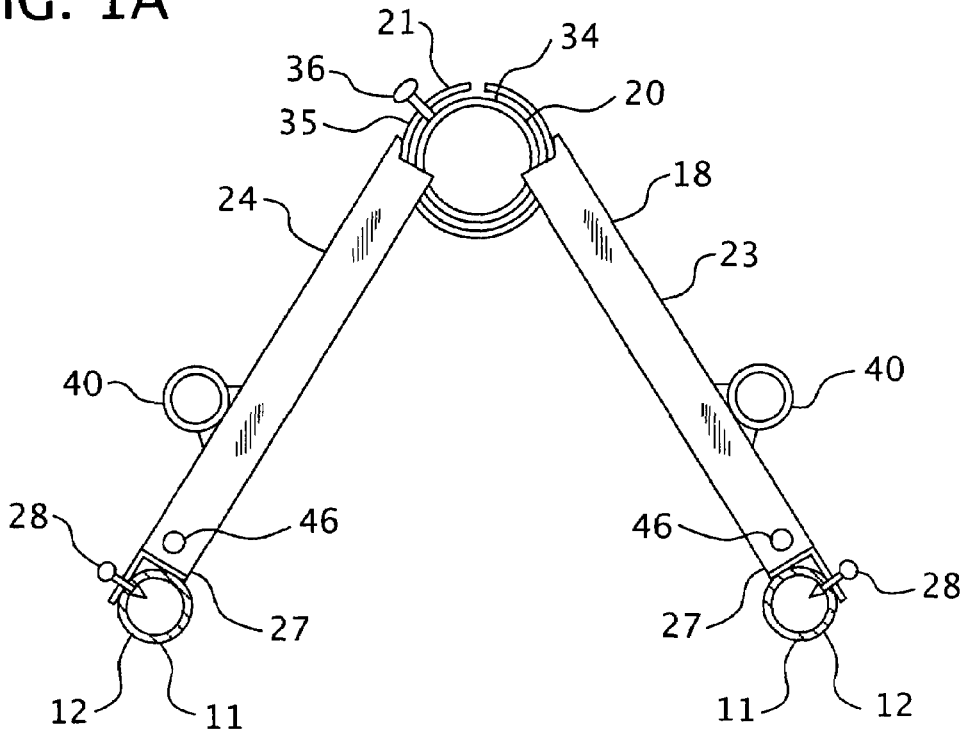
FIG. 1B is a top view of the upper V-shaped frame secured to a hand truck utilized in the mobile wire dispensing apparatus of the present invention.
Figure 2:
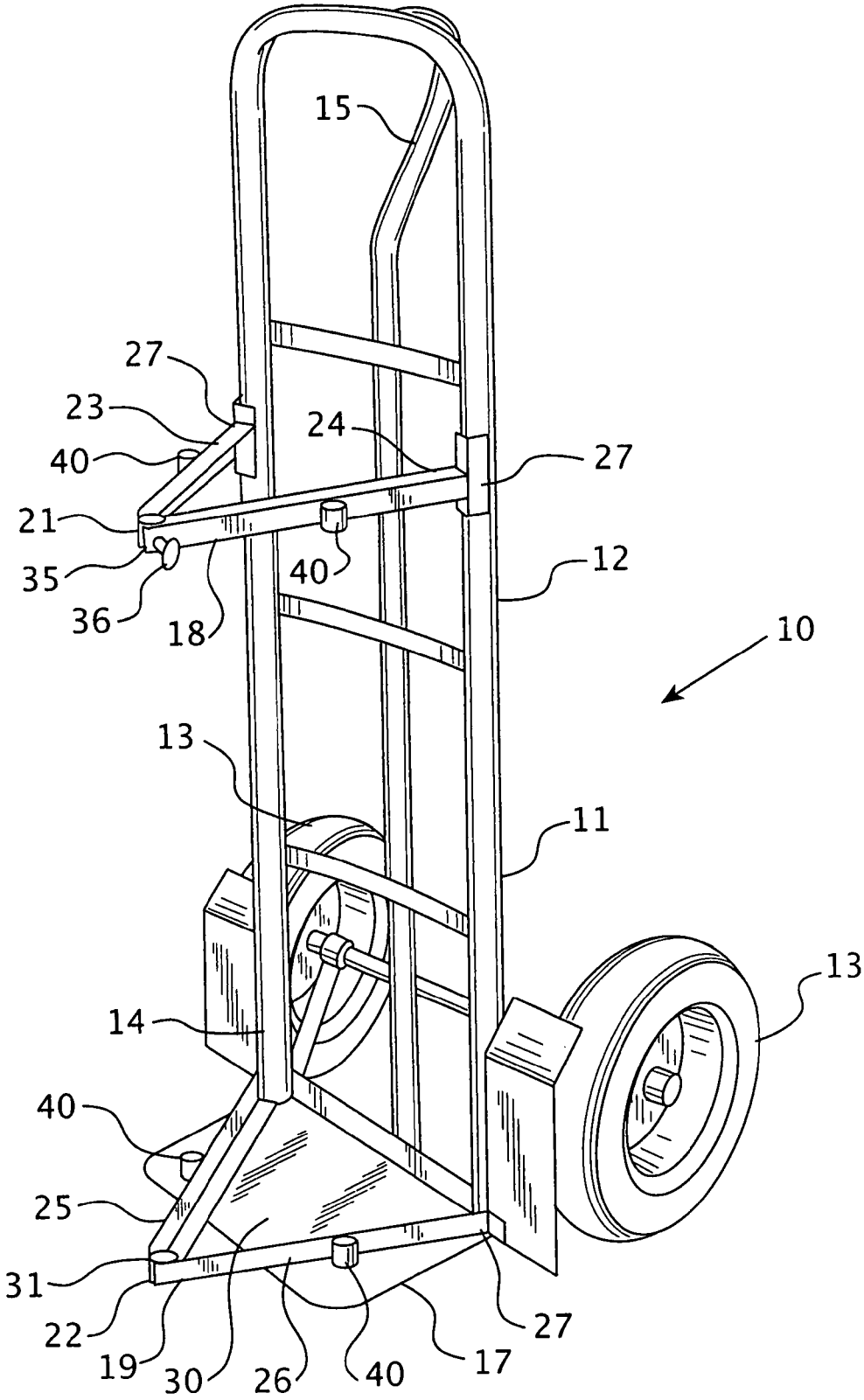
FIG. 2 is a perspective view of the upper and lower V-shaped frames secured to a hand truck shown in an upright position.

The shafts 41 and 42 may be stored next to the hand truck 11 when not in use with their bottom ends 43 received in sockets 45 and their upper ends 44 received in passages 46 in arms 23 and 24 as best seen in FIGS. 1B and 3.

The upper and lower V-shaped frames need not necessarily be configured as a V, and therefore they are referred to in the claims as being substantially V-shaped. This is intended to cover similar configurations, such as U-shaped, arched and rectangular.

I claim:

1. A mobile wire dispensing apparatus, comprising;

a hand truck including a longitudinally extending frame having wheels at one end and a handle at the other end for manipulating said frame for movement on said wheels and manipulating said frame from upright to horizontal, and a foot plate at said one end projecting at a substantially right angle from said frame;

upper and lower substantially V-shaped frames, each having an apex horizontally spaced from said frame in the same direction as said foot plate extends and two legs diverging horizontally from said apex to distal ends as said frame stands upright;

said lower V-shaped frame securable at its distal ends to said frame and resting against an upper surface of said foot plate as said frame stands upright;

said upper V-shaped frame securable at its distal ends to said frame in spaced parallel alignment with said lower V-shaped frame;

a hub socket on said apex of said lower V-shaped frame, and protruding toward said apex of said upper V-shaped frame to receive a wire spool core end thereover; and a shaft dimensioned to span between said apexes and to be received at one end into said hub socket after passing through at least one wire spool, and securable at the other end to said apex of said upper V-shaped frame.

2. The mobile wire dispensing apparatus of claim 1, including a through shaft sleeves on each leg of said V-shaped frames intermediate said apexes and said distal ends and aligned for thereby slidably receiving therein a parallel pair of spool shafts with bottom ends of said spool shafts engaging said foot plate as a stop.

* * * * *